United States Patent [19]

Kozak

[11] 4,001,986

[45] Jan. 11, 1977

[54] ARCHITECTURAL CONSTRUCTIONAL SYSTEM

[76] Inventor: John Kozak, 323 Leax Lane, Turtle Creek, Pa. 15145

[22] Filed: June 10, 1974

[21] Appl. No.: 477,983

[52] U.S. Cl. ..... 52/73; 52/236.3; 52/259; 52/284; 52/668

[51] Int. Cl.[2] ..... E04C 1/10; E04B 1/34

[58] Field of Search ..... 52/668, 284, 594, 593, 52/234, 236; 46/25, 17, 19, 28, 21; D34/15 FF; 256/19, 24, 25, 27

[56] References Cited

UNITED STATES PATENTS

| | | | |
|---|---|---|---|
| 1,271,160 | 7/1918 | Groves | D34/15 FF |
| 1,845,254 | 2/1932 | Fancher | 46/21 |
| 1,883,214 | 10/1932 | Wilson | 46/23 |
| 2,278,327 | 3/1942 | Magnus | 46/25 |
| 2,922,299 | 1/1960 | Deam | 52/608 |
| 3,143,236 | 8/1964 | Haas | 46/21 X |
| 3,461,626 | 8/1969 | Aitken | 52/82 |
| 3,566,558 | 3/1971 | Fisher | 52/236 |
| 3,844,124 | 10/1974 | Tupper | 61/37 |
| D213,709 | 4/1969 | Gale | 46/25 X |

FOREIGN PATENTS OR APPLICATIONS

| | | | |
|---|---|---|---|
| 574,588 | 3/1958 | Italy | 52/234 |

*Primary Examiner*—John E. Murtagh
*Attorney, Agent, or Firm*—Donn J. Smith

[57] ABSTRACT

A preformed structural panel comprises a generally rectangular precast slab having sufficient thickness for load-carrying capability, and a joining arrangement extending across the slab and spaced from opposed sides thereof. About one-half of the joining arrangement is a tapered solid region and the remainder of the joining arrangement is a complementarily tapered void region. The solid joining region is capable of interfitting tightly within the void region of a similar structural panel, and the void region is capable of receiving the solid region of the other panel in tightly interfitting relationship, so that the structural panel when thus interfitted is positively prevented from angular displacement with respect to such other panel.

The invention also contemplates unique building structures constructed from such panels.

27 Claims, 28 Drawing Figures

Fig. 2.
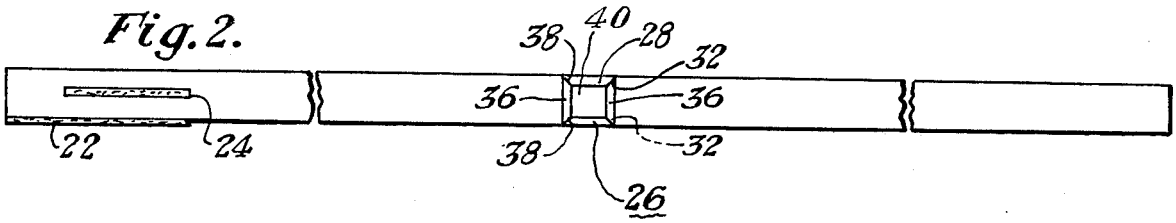
Fig. 1.
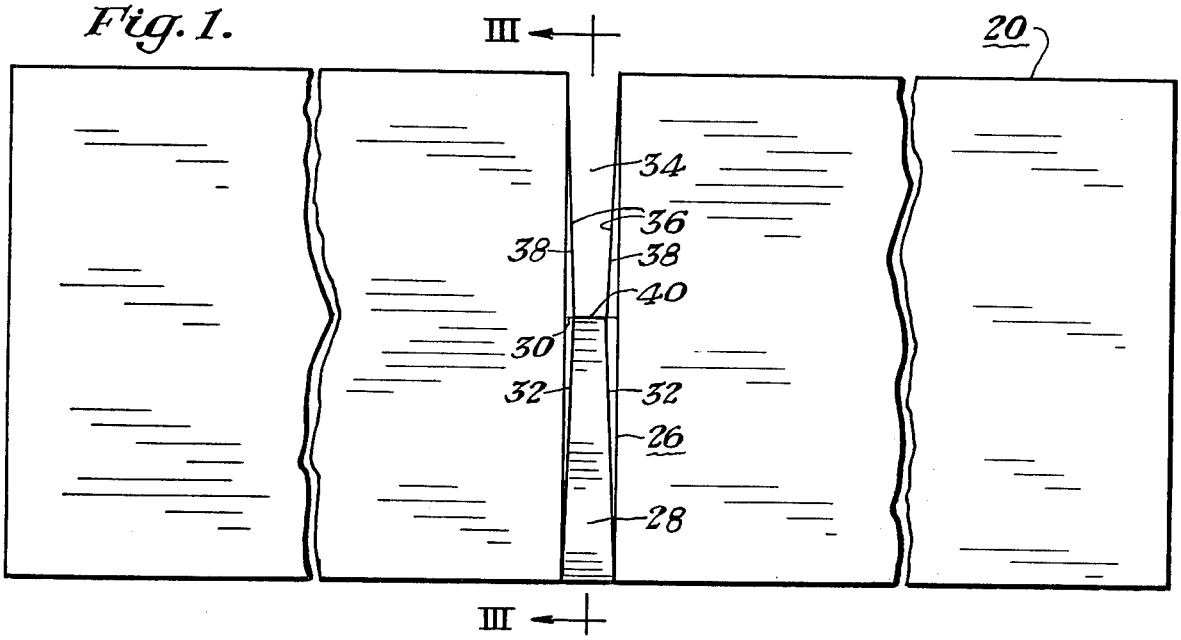
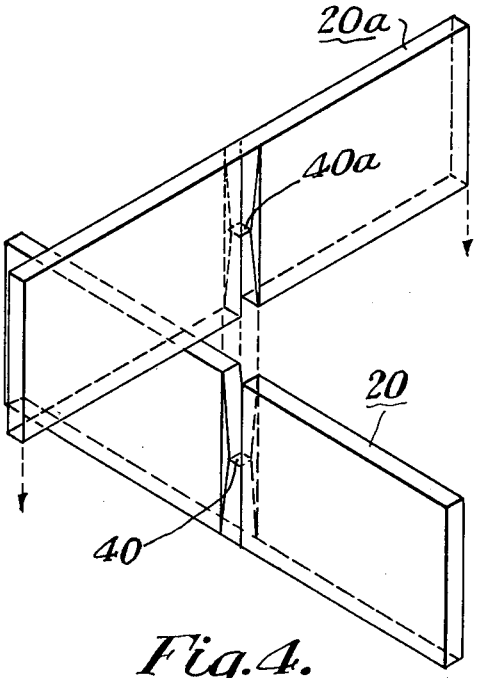
Fig. 4.
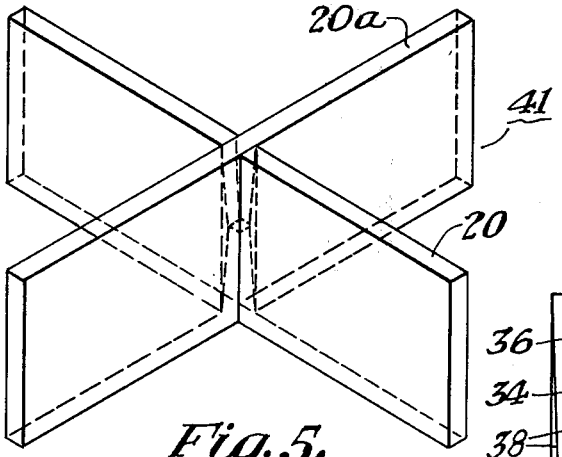
Fig. 5.
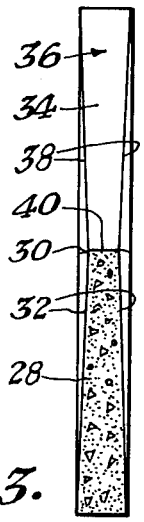
Fig. 3.

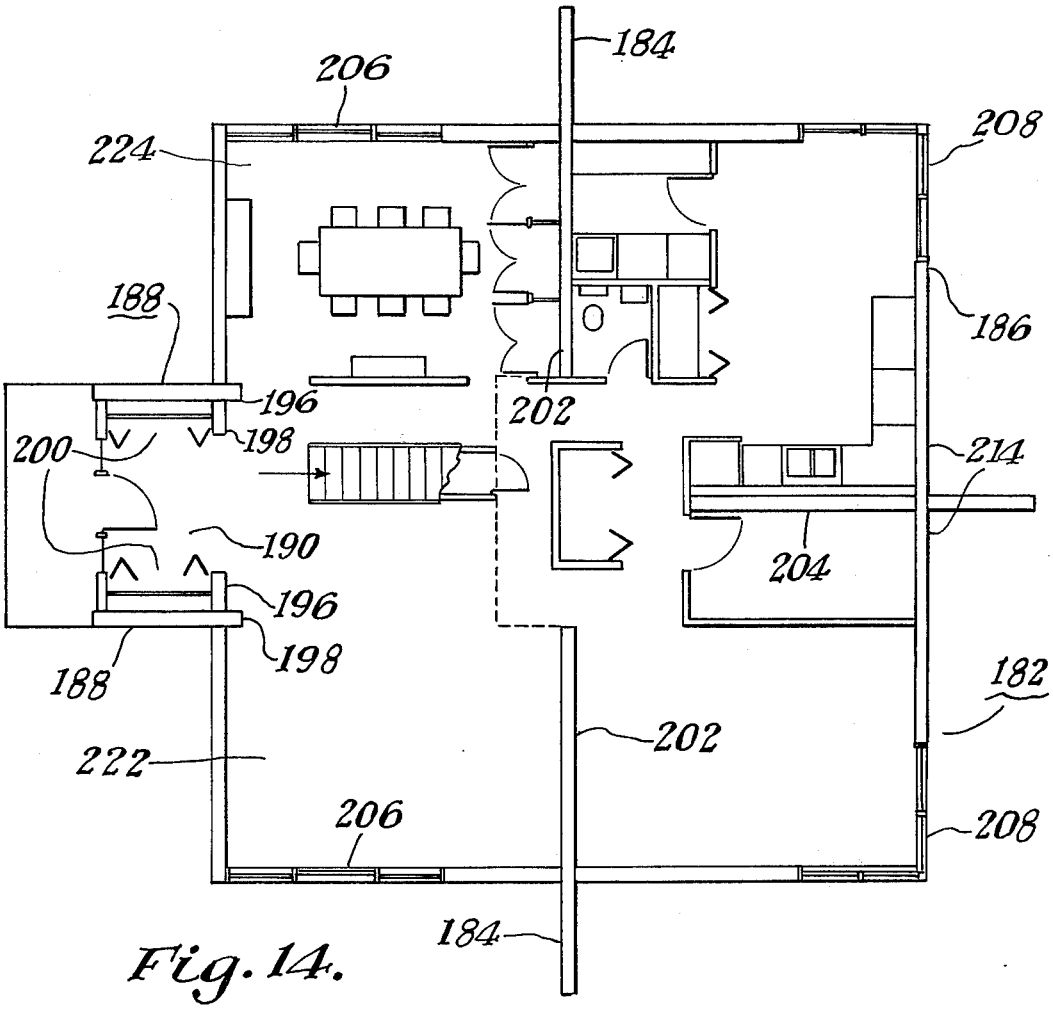
Fig. 14.
Fig. 17.
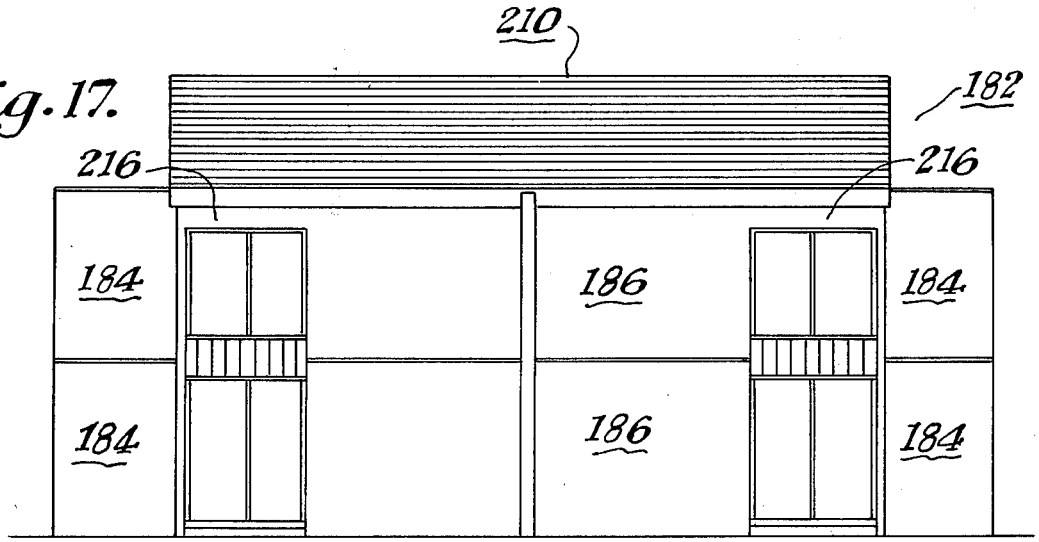

ARCHITECTURAL CONSTRUCTIONAL SYSTEM

The present invention relates to architectural constructional systems and more particularly to a relatively large structural panel made from reenforced concrete or the like, to a structural unit fabricated from at least two of such panels, and to building structures constructed from a number of such units.

The invention is directed to an improved building panel useful for constructing load-carrying walls and partitions and particularly useful for modular or synergistic type construction. The panels of the invention can be assembled unexpectedly into stabilized structural units which can be utilized repetitively in either horizontal or vertical directions or both throughout a given building. In one application of the invention the novel building panels can be assembled in pairs and to this end are each provided with joining means. The joining means of a pair of these panels mate in a unique fashion to provide a substantially rigid and stabilized joint between a pair of the panels. When properly assembled and positioned in the horizontal direction adjacent pairs of the panels can provide at least substantial portions of the walls of a room. A synergistic building structure having many rooms such as motels can be constructed in this fashion.

Alternatively, a number of pairs of the structural units of the invention can be assembled to provide the several rooms of an apartment or other dwelling, and such apartments can be repeated vertically and horizontally in synergistic fashion. In furtherance of this purpose, each of my novel building panels desirably is provided with a height equivalent to that of the usual apartment or office room.

Many attempts have been made in the past to prefabricate various types of structural units. Such units have suffered from lack of stability, particularly in multistoried construction or have lacked self-supporting characteristics or have otherwise been unwieldy in use. Conventional structural units or members usually require the use of mortar or other wet joints. The joints usually are not self-aligning, or otherwise require similar or other types of building units for their stabilized support. In contrast, my novel structural unit is capable of free-standing on a conventional foundation or other prepared support, or alternatively the structural units can be assembled atop one another in multi-storeyed construction.

Other building panels of known construction must be assembled in continuous or end-to-end fashion. Modular or synergistic construction is not practical. In those structural sites utilizing poured reeforced concrete other disadvantageous delays and difficulties are encountered in the use of large quantities of wooden forms and other subsequently discarded molding materials. Efforts have been made, therefore, to design precast or prefabricated structural units which can be produced off-site by means of permanent molds with considerable saving in time and cost both at the source of the prefabricated structural units and at the construction site itself.

In order to overcome the various disadvantages of the prior art and to accomplish the aforedescribed aims of the invention I provide a preformed structural panel comprising a generally rectangular precast slab having sufficient thickness for load-carrying capability, joining means extending across a central region of said slab, about one-half of said joining means being a tapered solid region and the remainder of said joining means being a complementarily tapered void region, said solid joining region being capable of interfitting tightly within a void region of a similar structural panel, and said void joining region being capable of receiving a solid joining region of said other panel in tightly interfitting relationship whereby said structural panel when thus interfitted is positively prevented from angular displacement relative to said similar panel.

I also desirably provide a similar construction including a second such slab, said second slab being inverted relative to said first-mentioned slab, and the joining means of said second slab and of said first-mentioned slab being interfitted as aforesaid, said interfitting relationship maintaining said second panel and said first-mentioned panel rigidly in a predetermined attitude relative to one another to form a structural unit.

I also desirably provide a similar construction including said solid region being configured as a truncated pyramid, said void region being shaped complementarily thereto.

I also desirably provide a similar construction including a building structure constructed from at least one such structural unit, and arms of said structural unit forming at least partially the bearing walls and partitions of said building structure.

I also desirably provide a similar construction including at least one additional structural unit spaced horizontally from said one structure unit, and curtain walls and nonbearing partitions for completing the walls of said building structure.

I also desirably provide a similar construction including an arm of said structural unit extending exteriorly of said building structure for a flying buttress effect.

I also desirably provide a similar construction including an arm of said including the tapering of said void unit extending exteriorly of said building structure for a flying buttress effect.

I also desirably provide a similar construction including the tapering of said void region being disposed at a different rotative position relative to the tapering of said solid region.

I also desirably provide a similar construction including at least one additional such unit, at least two such units being stacked one atop the other to form a multistoreyed building structure.

I am aware of the following U.S. patents relating to structural units and building constructions:

| | | | |
|---|---|---|---|
| Loucks | 2,134,637 | Wood et al | 2,309,149 |
| Smith | 2,326,503 | Justus | 2,902,733 |
| Bender | 2,930,222 | Walsh | 2,960,249 |
| Rose | 3,113,401 | Schmidgall | 3,166,802 |
| Nelson | 3,346,998 | | |

The foregoing patents, however, do not disclose, either singly or in combination, the novel features of my invention as pointed out above.

During the foregoing discussion, various objects, features and advantages of the invention have been set forth. These and other objects, features and advantages of the invention together with structural details thereof will be elaborated upon during the forthcoming description of certain presently preferred embodiments of the invention and presently preferred methods of practicing the same.

In the accompanying drawings I have shown certain presently preferred embodiments of the invention and have illustrated certain presently preferred methods of practicing the same wherein:

FIG. 1 is a front elevational view of one form of structural panel made in accordance with my invention;

FIG. 2 is a top plan view of the panel shown in FIG. 1;

FIG. 3 is a vertically sectioned view of the panel shown in FIG. 1 and taken along reference line III-III thereof;

FIG. 4 is an exploded isometric view of the synergistic structural unit of the invention showing the manner of joining two of the panels shown in FIG. 1 to form such structural unit;

FIG. 5 is an isometric view of an assembled synergistic structural unit of the invention;

FIG. 14 is a first floor plan view of another building construction arranged in accordance with the invention and utilizing my novel synergistic structural units;

FIG. 17 is a rear elevational view of the building construction shown in FIGS. 14 and 15;

Figure 6:
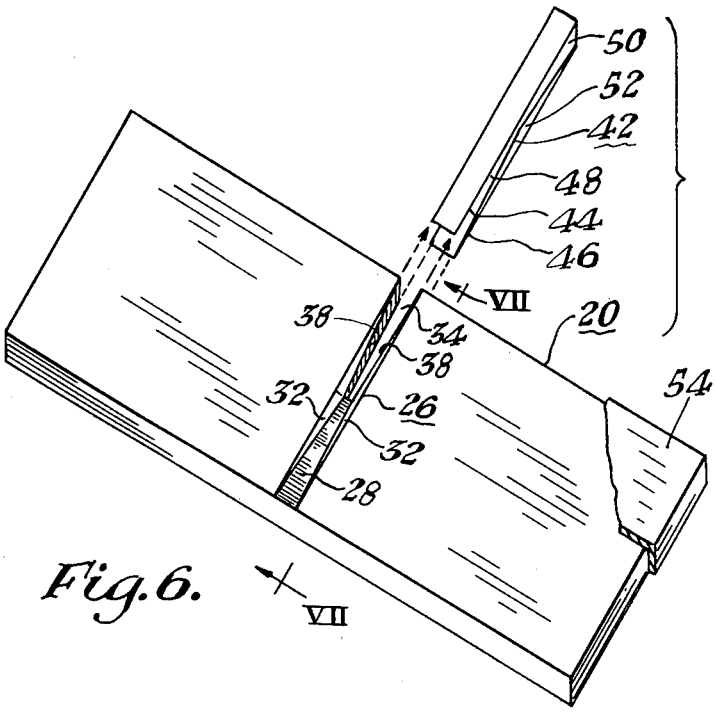
FIG. 6 is an exploded isometric view illustrating one method of forming the joining means of the panels shown in the preceding figures.

With reference now more particularly to FIGS. 1–3 of the drawings my synergistic building panel 20 is generally and desirably rectangular in configuration having a height about equal to that of a typical room in a given building construction (FIGS. 8–10, for example) in which the panel is to be used. In the horizontal direction the panel 20 can be provided in nearly any suitable and desired length. Generally, the panel 20 will have its larger dimension in the horizontal direction.

As to its internal structure, the panel 20 can be precast from reinforced concrete in the usual manner of constructing reinforced concrete slabs. Accordingly, a particular and conventional array of reinforcing wires or rods need not be illustrated here, although such can be employed within the skill of the art.

The panel 20 can be insulated, where necessary or desirable my means of a series of panels of foamed styrene denoted generally at 22 or the like, which can be glued or otherwise secured to an outer face of the panel. Alternatively suitable insulation boards or sheets 24 also of conventional fabrication can be cast integrally within the panel 20, as by suitably positioning the insulation panels within a permanent mold or the like into which ready-mixed concrete or other structural material is poured to form the panels or slabs 20.

Each of my synergistic panels 20 is provided with uniquely located and uniquely configured joining means 26. In the illustrated arrangement of the invention, the joining means 26 are located centrally of the panel 20 (as evident from FIGS. 1 and 2) and desirably coextend with the shorter or vertical dimension of the panel 20. The adjoining means 26 include lower, solid section 28 which is tapered upwardly and inwardly to central area 30 of the junction means. The solid region 28 is essentially a rather narrow, truncated pyramid formed by adjacent, increasingly chamfered edge 32 of the panel 20. The upper area of the joint 26 defines a complementary void area 34, which is defined by gently sloping surfaces 36 of the joining means 26 and their increasingly chamfered edges 38. The void region 34 and the oyramidal region 28 are essentially complementary both as to volume and configuration so that when one of the panels 20, for example the panel 20*a* of FIG. 4 is inverted over the panel 20 the uppermost or truncated surface 40 of the pyramid 28 serves as a stop for the truncated surface 40*a* of the upper panel 20*a* (FIG. 4).

As the upper panel 20*a* (FIG. 5) is lowered to its operative position, the gently sloping sides of the joining means 26 of each of the panels permit the pyramidal regions 28 to be easily mated within the complementary void regions 34, by providing working tolerances at the initial engagement between the panels. As the joining means 26 of the pair of panels 20, 20*a* are slid together the panels are self-aligned and self-plumbed as they are joined. The junction between the pair of panels becomes tighter as the panels are moved together, and the upper panel 20*a* requires no independent shoring or alignment for structural stability. The weight of the upper panel 20*a* drives the joining means 26 of the two panels 20, 20*a* completely together so that the panels form a unitary structural member 41 as shown in FIG. 5. A unitary and rigid junction is formed thereby between the panels 20*a*, 20 without the use of a wet joint, and the two slabs 20, 20*a* are held rigidly at right angles in the illustrated example.

In addition to their function in the complementary engagement of the joining means 26 of the pair of panels, the several chamfered edges 32, 38 minimize the damage and handling that might occur with squared corners. As the panels are finally mated (FIG. 5) there is a positive bearing contact between the various surfaces of the junction means 26 thereof owing to the sloping sides and edges of the junction means 26.

Figure 7:
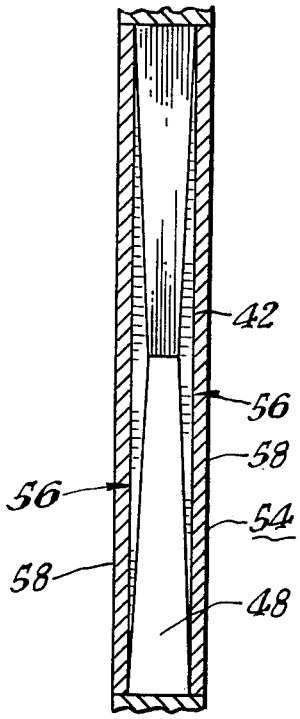
FIG. 7 is a cross sectional view of the panel and mold shown in FIG. 6 and taken along reference line VII—VII thereof.

The sloping sides of the junction means also permit ready removal of a reusable mandrel 42 employed to mold the junction means 26 in accordance with one fabricational method, as illustrated in FIGS. 6 and 7. The mandrel 42 in this example is a bifurcate member. The bifurcations 44, 46 and the void area 48 therebetween cooperate to form the truncated pyramidal portion 28 of the panel 20, along with the tapered and chamfered edges 32 adjacent thereto. On the other hand a pyramidal region 50 of the mandrel 42 and the tapering, beveled surfaces 52 adjacent thereto determine the complementary void region 34 and adjacent chamfered edges 38 of the panel 20.

In operation, the reusable mandrel 42 is located centrally within the relatively flat, rectangular mold structure 54 (FIG. 7) having suitable outer dimensions capable of molding the rectangular outlines of the panels 20. The mandrel 42 is oriented in the mold as better shown in FIG. 7 with its outer flat sides 56 lying flush against the large rectangular sides 58 of the mold structure such that poured concrete or other molding material can flow throughout the mold and communicate through the void area 48 of the mandrel 42. As noted above the void area 48 also forms the pyramidal region 28 of the joining means 26 of each panel 20 formed in the mold structure 54.

After setting up and removal of the slab 20 from the mold structure 54 the double-sloping areas of the joining means 26 formed by the mandrel 42 provides the necessary draft for removal of the reusable mandrel 42 as evident from FIG. 6.

Figure 8:
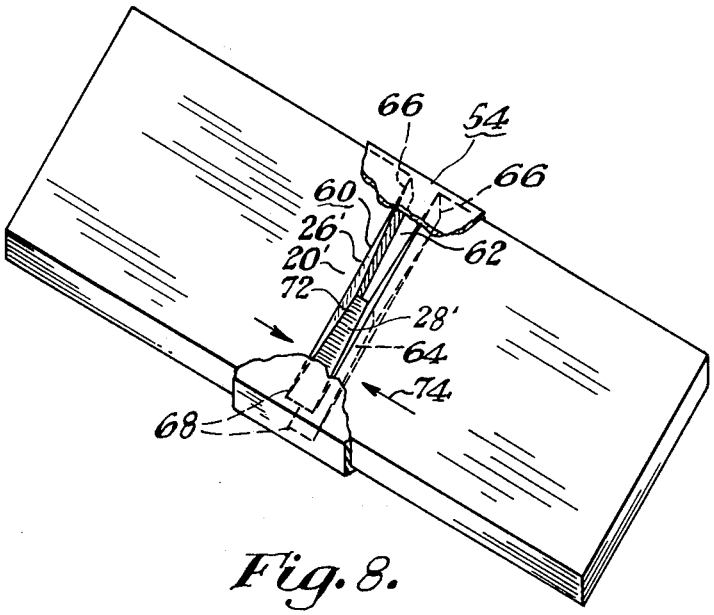
FIG. 8 is an isometric view of a similar panel but showing another method for fabricating the joining means thereof.
Figure 8A:
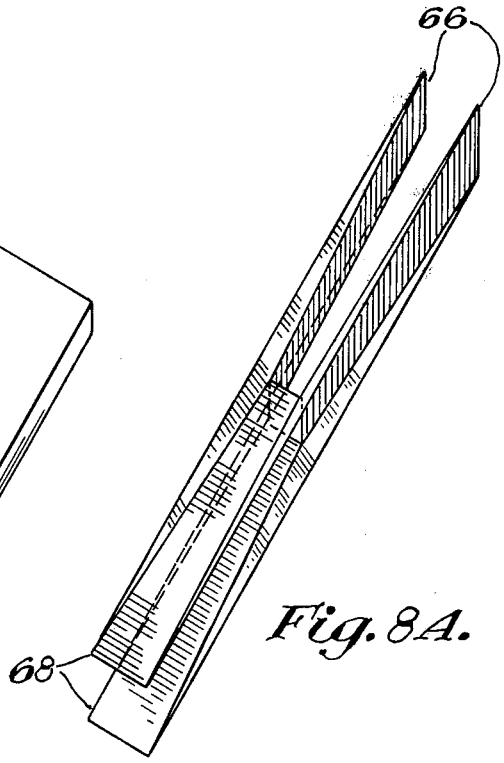
FIG. 8A is an enlarged isometric view of a lost mandrel which can be employed in forming the architectural panel illustrated in the preceding FIG. 8.

Another fabricational method for the joining means 26′ of a similar architectural panel 20′ is illustrated in FIGS. 8 & 8A. In this example of the invention, the joining means 26′ are formed essentially with the use of a lost mandrel 60 for each building panel 20′. The lost mandrel 60 can be formed from sheet steel or other suitable structural material and is doubly bifurcated so as to provide an upper void area 62 and a lower void area 64. The outer surfaces of the upper legs 66 as well as the outer surfaces of the lower legs 68 are each dished to provide the chamfered edges and other tapered surfaces substantially identical to the surfaces of the joining means 26 of the preceding Figures.

As evident from FIG. 8A the upper legs 66 of the lost mandrel 60 have a rotative orientation substantially at right angles to the lower legs 68. In consequence when the lost mandrel 60 is placed in the mold structure 54 as shown (but before shoring of the concrete or other material forming the panel 20′), the poured material can communicate between the lower legs 68 to form the solid, pyramidal area 28′ of the joining means 26′, as denoted by flow arrows 74. At the same time the outwardly flared edges 70 of the upper and lower legs engage the adjacent sidewalls of the mold structure 54 to prevent the poured materials from flowing into and filling the outer dished areas 72 of the lower legs 68, only.

Where the outer flared edges of the lost mandrel 60 extend along the upper legs 66 thereof the poured material also is prevented from entering between the upper legs 66, owing to their differing orientation within the mold structure 54, in order to provide the complementary void region 62 of the joining means 26′. The poured material of course fills the shallow, dished areas of the upper legs 66 to back-up the chamfered and inclined areas of the upper legs 66 to afford a structurally rigid joining means 26′. The panel 20′ of FIG. 8 exhibits the advantage of having exceptionally smooth joining surfaces of the joining means 26′.

Figure 9:
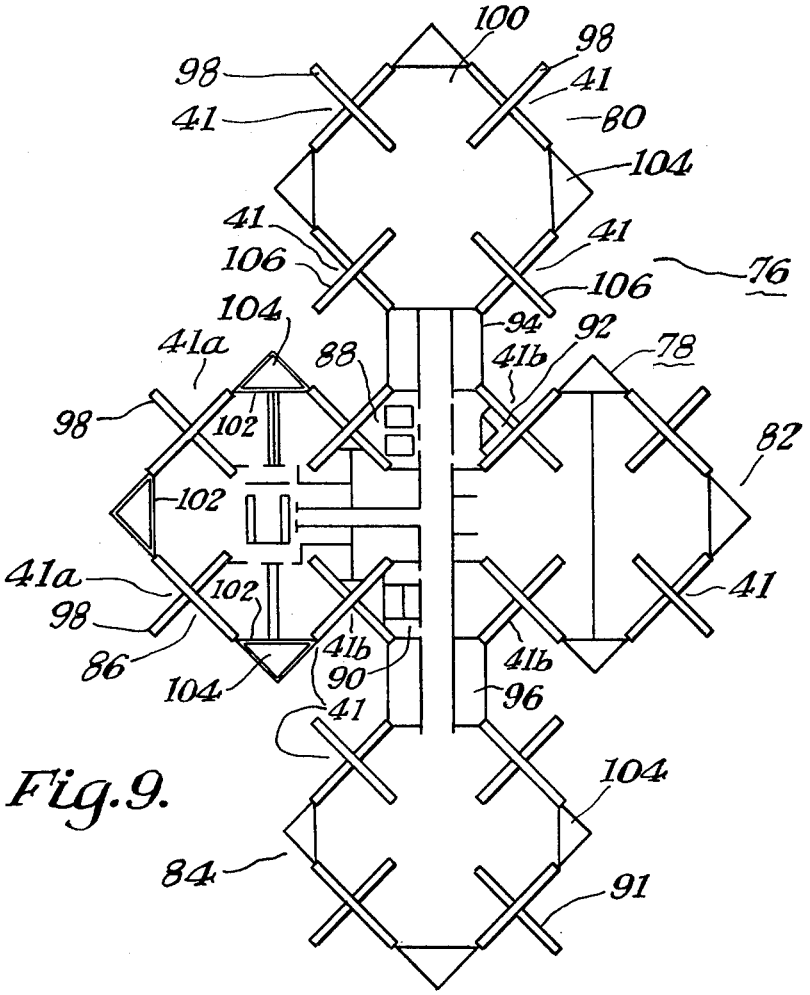
FIG. 9 is a top plan view of one floor of a synergistic building construction such as an apartment house, utilizing a number of my synergistic structural units.

An illustrative building construction 76 utilizing a number of my synergistic structural units 41 is shown in FIG. 9. The building 76 is arranged desirably as a multistoreyed apartment dwelling, a schematic layout of one-story 78 of which is shown in FIG. 9. The floor layout 78 includes in this example four apartment dwellings, with one such apartment in each wing 80, 82, 84 or 86. In the areas between the two closer wings 82, 86 conventional elevators and/or stairways designated respectively by reference numerals 88, 90, 92 respectively can be constructed. The more distant wings 80, 84 can communicate respectively with the aforementioned central ascent-descent areas 88–92 by means of access passageways 94, 96 of conventional construction. It will be understood that the building of FIG. 9 can be one-storeyed or can be provided with a different number of wings from what is shown.

The primary support and stabilization of each of the building wings 80–86 is provided in this example by series of the structural units 41, which, for a multistoreyed structure, can be mounted jack-over-jack, with four of the structural units 41 grouped in the horizontal direction to form a given floor of the wing as shown. If desired, the abutting edges of the structural units 41, when mounted one atop the other, can be tongue and grooved, or knife-edged and v-grooved for enhanced structural stability. Other keying means naturally can be substituted.

A typical apartment layout is shown in the wing 86, which is arranged as a four bedroom, three bath dwelling. It will be seen that three arms of the outer structural units 41*a* form bearing walls and partitions of the building wing 86. The fourth arm 98 of each of these units provides in effect an exterior support or flying buttress for the building construction 76. The inward two structural units 41*b* lend all four of their arms to the provision of bearing walls and bearing partitions of the building construction, wherein the juxtaposed arms of the four inner structural units 41*b* largely define the aforementioned ascent-descent passageways 88–92.

Within each apartment area a number of non-bearing partitions can be constructed as shown which, together with the adjacent arms of the structural units 41, form the various rooms and access ways conventionally required in a typical apartment layout. Alternatively some or all of the rooms and their non-bearing partitions, particularly such rooms as the kitchens and the bathrooms requiring extensive built-in cabinetry, etc., can be completely prefabricated for placement as one or more complete room units among the inwardly extending arms of the horizontally spaced structural units 41. Prior to such installation, however, a prefabricated floor slab 100 or the like is laid upon suitable bearing ledges therefor formed on the structural units of each floor. Alternatively the floor slab 100 can be laid directly on the top edges of the units of the storey below. Such prefabricated floor can serve as the ceiling for the storey below, unless a dropped ceiling arrangement is utilized for the purpose of concealing conduits and duct work.

To provide a more pleasing shape for the various rooms of the apartment unit, curtain walls 102 desirably are constructed between the adjacent ends of those arms of the structural units 41 forming the outside corners of the building construction 76. If desired, one or more balconies 104 of conventional construction, save for their triangular configuration can be constructed outside of the curtain walls 102 for the usual functional reasons and to lend aesthetic character to the building construction 76. The outer walls of the exterior of the balconies 104 extend in coplanar fashion from the adjacent arms respectively of the units 41.

The two more widely separated wings 80, 84 are similarly constructed save that they are in effect provided with four flying buttresses 98, 106 instead of two as in the remaining building wings 82, 86.

Figure 10:
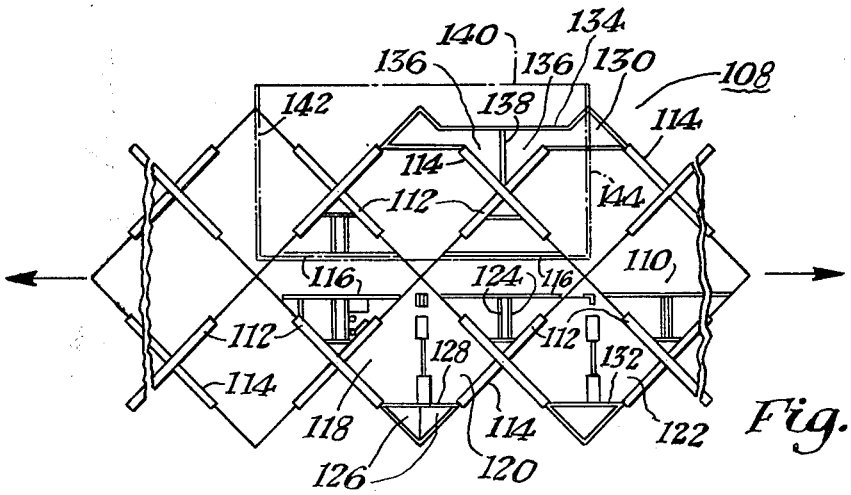
FIG. 10 is a top plan view of another modular building construction of the invention and illustrating the repetitive nature thereof.
Figure 11:
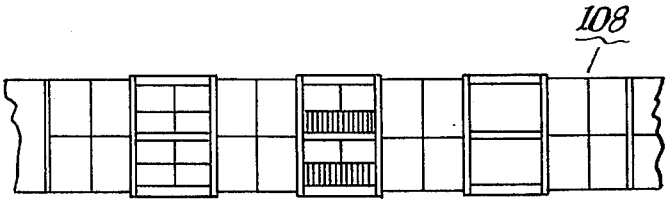
FIG. 11 is a front elevational view of the building construction shown in FIG. 10.

FIGS. 10 and 11 illustrate the application of my synergistic modular structural units in the construction of an elongated building such as a motel or motor hotel. As illustrated, the floor plan of FIG. 10 is broken off at each end to emphasize the repetitive nature of my synergistic building construction to form a building of indeterminate length, the actual length of which can be determined by the usual circumstances. FIG. 11 illustrates primarily a multi-storeyed construction to which the synergistic building construction of the invention is readily adapted.

Referring again to the floor plan of FIG. 10, it will be seen that a central corridor 110 can be extended between the near arms 112 of the structural units 114 by constructing a series of non-bearing partitions 116. Similarly, more or less conventional non-bearing partitions can be constructed generally between each adjacent pair of the structural units 114 to divide the areas between two motel or hotel type sleeping rooms 118, 120 or into a bedroom-sitting room suite or efficiency apartment 122. Traditional non-bearing partitions 124 can divide the areas between the corridor partitions 116 and the adjacent arms of the juxtaposed structural units 114. As in the building construction illustrated in the preceding figure, the various room units can be prefabricated.

A divided balcony 126 and curtain wall 128 can be constructed adjacent the ends of the outer arms of the spaced pair of structural units 114 defining the sleeping rooms 118, 120, or an undivided balcony 130 and curtain wall 132 can be constructed adjacent the suite 122.

An alternative balcony arrangement also is shown in FIG. 10 wherein an outer curtain wall 134 joins two of the balconies 130 to form an additional and larger triangular balcony area 136 which in turn can be subdivided by non-bearing partition 138 for private access by occupants on either side of the balcony 136.

It will be observed that the flying buttress effect of the building construction of FIG. 9 is not visibly apparent in the building construction of FIGS. 10 and 11. However, it will be apparent that use of the structural unit 114 for both bearing walls and bearing partitions is analogous to the employment of the structural units 41 of FIG. 9. It will also be apparent that a number of the structural units 41 or 114 can be apparent that a number of the structural units 41 or 114 can be assembled in a large number of widely varying configurations, without departing from the structural principles disclosed in FIGS. 9–11.

It will also be understood that the building units 41 or 114 need not be deployed in groups of four. For example two or more of the structural units can be employed in tandem and spaced horizontally to form an apartment dwelling or motel type structural unit as evident from that portion of the building constructed within chain outline 140 of FIG. 10. In the building construction 140 the central corridor 110 is obviated and the adjacent partitions 116 become exterior curtain walls. Likewise, end curtain walls 142, 144 can be constructed as required. It will be understood that a different number of my structural units 114, such as three or more or even one such unit, can be employed in the building construction 140.

It will also be understood that differing decorative or aesthetic balcony constructions, such as rectangular or some other configuration can be substituted for the triangular balcony constructions shown in FIGS. 9 and 10. The building layout of FIG. 10 can be one-storied, if desired and can be arranged as a single family, duplex or triplex dwelling.

Figure 12:
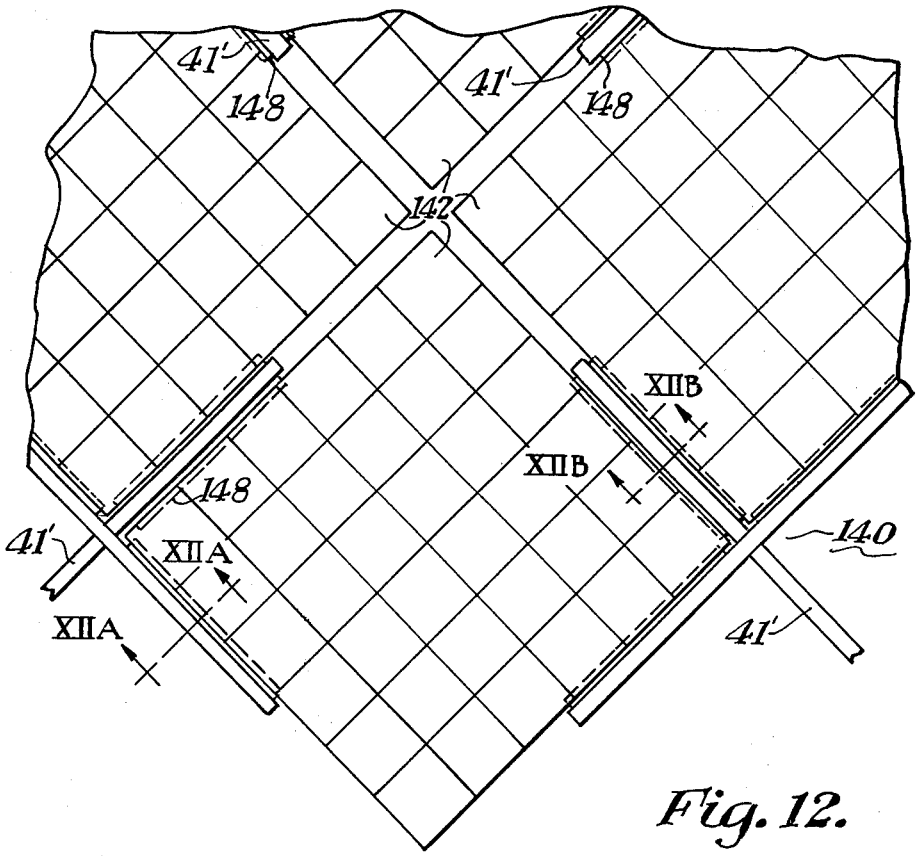
FIG. 12 is a partial plan view of a floor or ceiling construction useful in any of the building constructions illustrated herein.
Figure 12B:
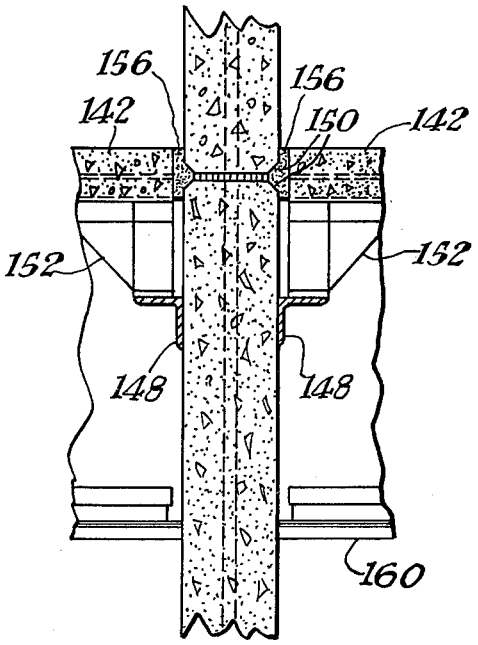
FIG. 12B is a similar view taken along reference line 12B—12B of FIG. 12.
Figure 12A:
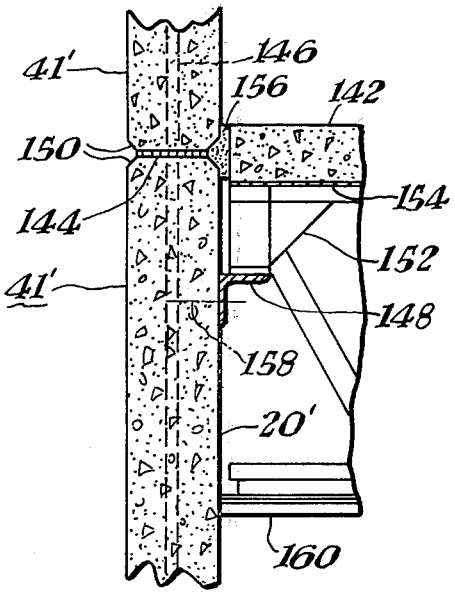
FIG. 12A is an enlarged sectional view of the building construction shown in FIG. 12 and taken along reference lines 12A—12A thereof.

With reference now to FIGS. 12, 12A and 12B of the drawings an exemplary structural configuration 140 for supporting a number of identical floor/ceiling panels 142 is illustrated. Each of the floor/ceiling panels 142 is identical and is supported in this example from four series of the structural units 41' described previously. As evident from FIGS. 12A and 12B each series of structural units 41' can be mounted jack-over-jack for a multi-storied building construction.

In the latter configuration a continuous bearing and sealing pad 144 of suitable material, such as foamed polyurethane saturated with polybutylene made by Sundell Mfg. Co. Inc., Cambridge, Mass., under its trademark, POLY-TITE, can be inserted between each structural unit 41' and the overlying unit 41'. Desirably also, a number of vertical post-tensioning tendons 146 can be extended through registering apertures in each of the jack-over-jack structural units 41' for the purpose of preloading the units for overall vertical tensioning of the building structure.

A number of load bearing angle irons 148 are secured to confronting surfaces of each juxtaposed pair of the structural units 41' at a distance below the junction between each pair of jack-over-jack structural units. Such junction is represented by the aforementioned bearing pad 144. Desirably the upper and lower edges of each structural unit 41' are champferred as denoted by reference numerals 150 (FIGS. 12A, 12B) to form a continuous notch or groove extending along the aforementioned junctions.

The steel framework denoted generally by reference numerals 152 (FIGS. 12A, 12B) rests upon the angle irons 148 and extends between each confronting pair of the structural units 41'. A steel decking 154 overlies the structural framework 152, and on the decking 154 the associated floor slab 142 is mounted. The clearances between the vertical edge surfaces of each floor/ceiling slab 142 and the associated structural units 41' are filled with a non-shrinking grout 156, which is held in place by the aforementioned grooves or notches formed by the champferred edges 150. The aforementioned angle irons 148 can be secured to the structural units 41′ by means of mounting bolts or other suitable fasteners 158 imbedded in the structural units 41′, when the latter are cast or molded. If desired, the bolts 158 can be welded or otherwise secured to a reinforcing framework of the individual slabs 20′, from which the structural units 41′ are assembled.

A fire rated acoustical ceiling 160, or other conventional drop ceiling can be constructed a predetermined distance below each of the floor/ceiling slabs 142.

With reference now to FIGS. 13, 13A, 13B and 13C of the drawings, another arrangement according to the invention for supporting precast floor/ceiling panels is illustrated. In the latter modification of the invention similar reference numerals with primed accents denote similar components of the preceeding FIGS. 12, 12A and 12B. In the FIG. 13 modification (as in FIG. 12) four identical floor/ceiling panels 162 are likewise supported from four series of structural units 41′. The floor/ceiling units 162, however, are self-supporting and are cast from reinforced concrete in accordance with known and accepted building techniques.

The structural units 41′ can be assembled jack-over-jack as in the preceding Figures and as in the case of FIG. 12 a larger or smaller number of the structural units 41′ and floor/ceiling panels 162 can be employed. In fact in both of the FIG. 12 and 13 modifications of the invention the floor/ceiling panels and the structural units 41′ can be extended either horizontally and/or vertically as desired for a typical hotel/motel configuration, as described in earlier figures of the drawings.

Figure 13:
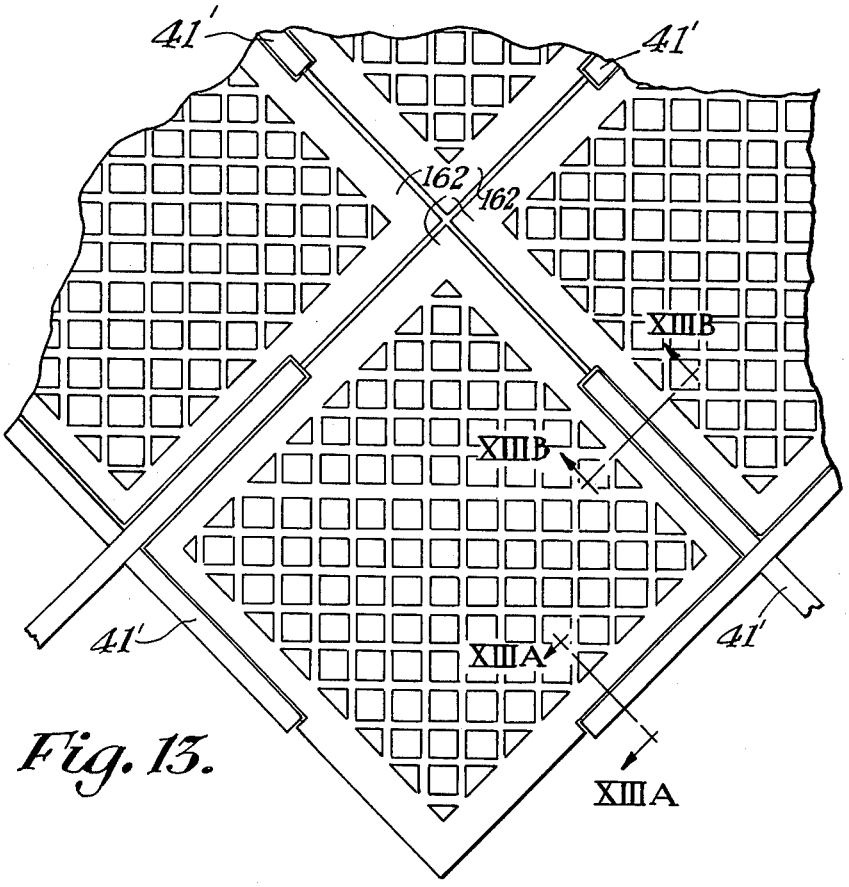
FIG. 13 is a view similar to FIG. 12 of an alternative floor or ceiling arrangement.
Figure 13B:
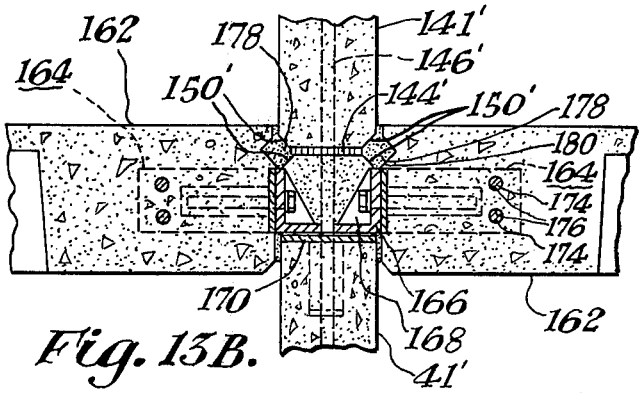
FIG. 13B is a similar view taken along reference lines 13B—13B of FIG. 13.
Figure 13A:
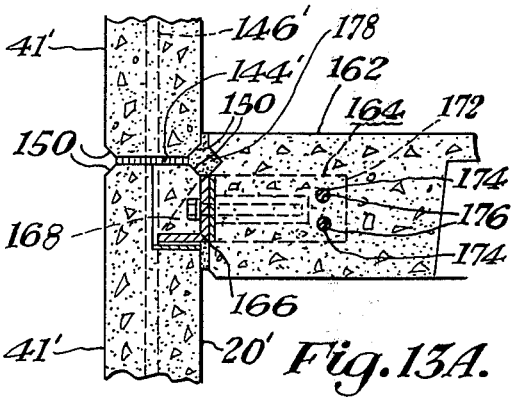
FIG. 13A is an enlarged sectional view of the building construction shown in FIG. 13 and taken along reference lines 13A—13A thereof.
Figure 13C:
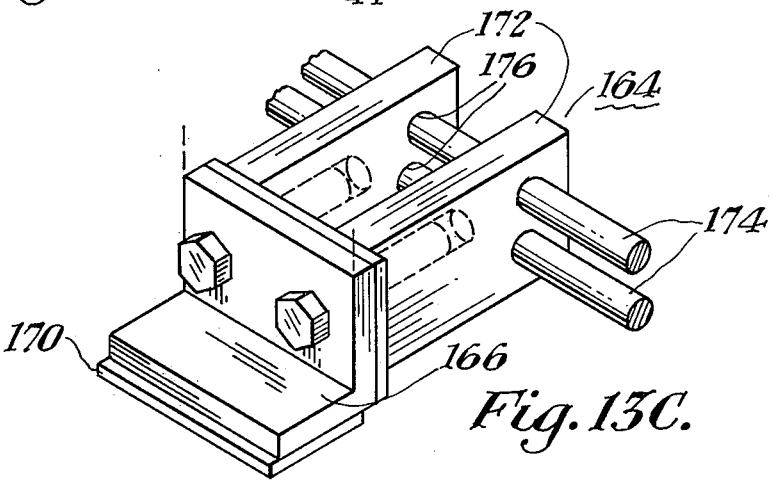
FIG. 13C is a partial isometric view, with parts broken away and other parts removed, of the floor/ceiling joint construction as shown in FIGS. 13A and 13B.

Each of the floor/ceiling panels 162 is provided in this example with four shear connections 164, one of which is shown in detail in FIG. 13C. The shear connections 164 are embedded within the relatively thick peripheral or edge portions of the floor/ceiling panels 162 as shown in FIGS. 13A and 13B. These edge portions in effect form supporting beams along the peripheral edges of each floor/ceiling panel 162. The beam networks thus formed are particularly useful for stabilizing the otherwise unsupported corner portions (FIG. 13) of the panels 162.

Each of the shear connections 164 includes a relatively short length of heavy angle iron 166, the horizontal edge of which is seated in an associated and complementary notch structure 168 moulded in the juxtaposed surface of the structural unit 41′. The horizontal surfaces of the notches 168 are reinforced with steel plates 170, which can, if desired, be welded or otherwise joined to steel reinforcements of the structural units 41′.

The vertical surfaces of the angle irons 166 are bolted to a pair of tapped supports 172 forming part of the shear connections 164. In the illustrated embodiment a pair of the tapped supports 172 are illustrated, although a different number can be utilized. The tapped supports 172 are embedded within the associated floor/ceiling panels 162. In order to stabilize and strengthen each of the shear connections 164, the inward ends of the tapered supports 172 desirably are rigidly joined to a pair of rods 174 (FIG. 13C) likewise embedded in the floor/ceiling panels 162 as better shown in FIGS. 13A and 13B. In furtherance of this purpose each of the support members 172 can be provided with a pair of apertures 176 through which the rods 174 are respectively inserted. The rods 172 can form part of the steel reinforcement (not shown) of the panels 162 or can be embedded independently of such reinforcement. As in the case of the supports 172, a different number of the rods 174 can be employed, depending upon the mass of the panels 162.

When thus supported each of the panels 162 can be further stabilized by non-shrink grouting material 178, which fills the peripheral clearances between the floor/ceiling slabs 162 and the structural units 41′. In furtherance of this purpose, each of the slabs 162 can be provided with a peripheral groove 180 juxtaposed to the chamferred edges 150′ of the structural units 41′ (when the latter are employed jack-over-jack or in a multi-storied relation) in order to provide a keying configuration for the grout 178 (FIGS. 13A, 13B).

Another building construction 182, according to my invention, is shown in FIGS. 14–17. The building construction 182 is arranged in this example as a storey-and-a-half, single-family residence. The first floor of the residence 182 is delineated by a number of my novel structural units 184, 186, 188.

Figure 15:
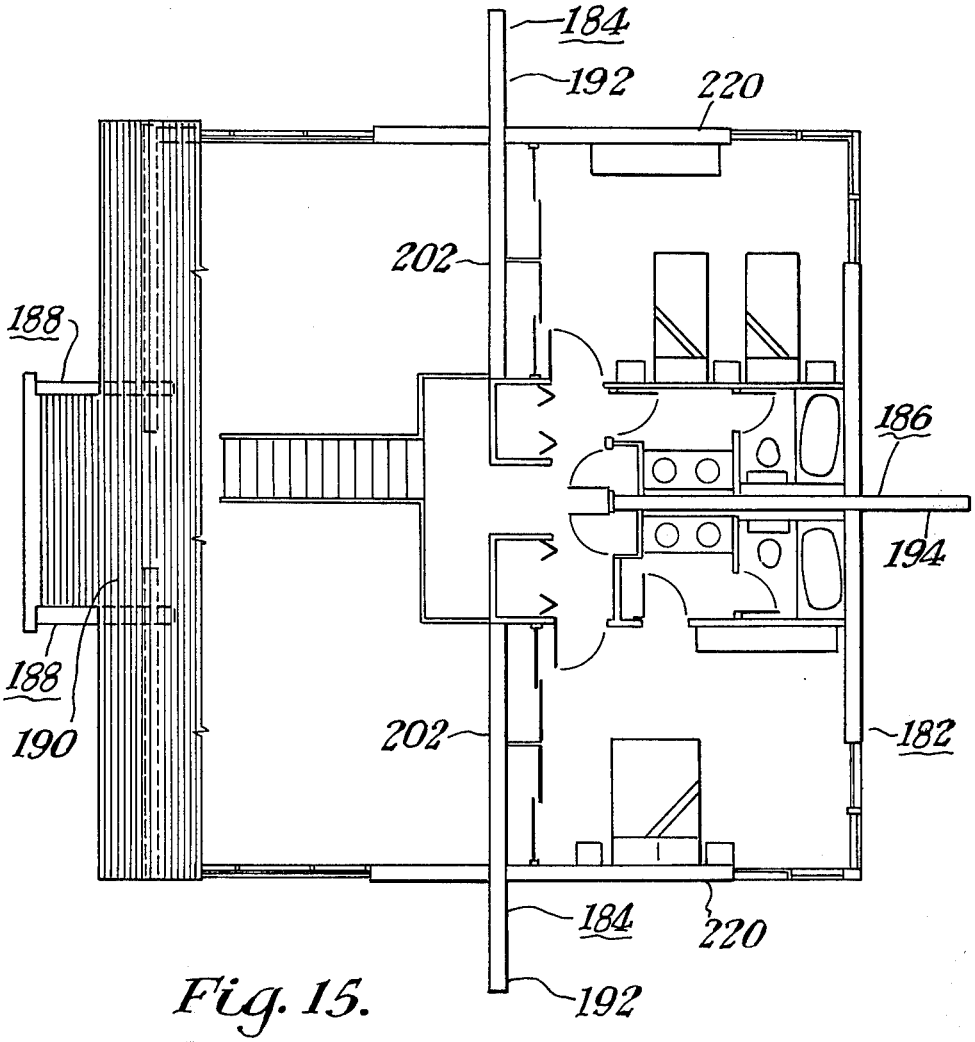
FIG. 15 is a second floor plan view of the building construction shown in FIG. 14.
Figure 16:
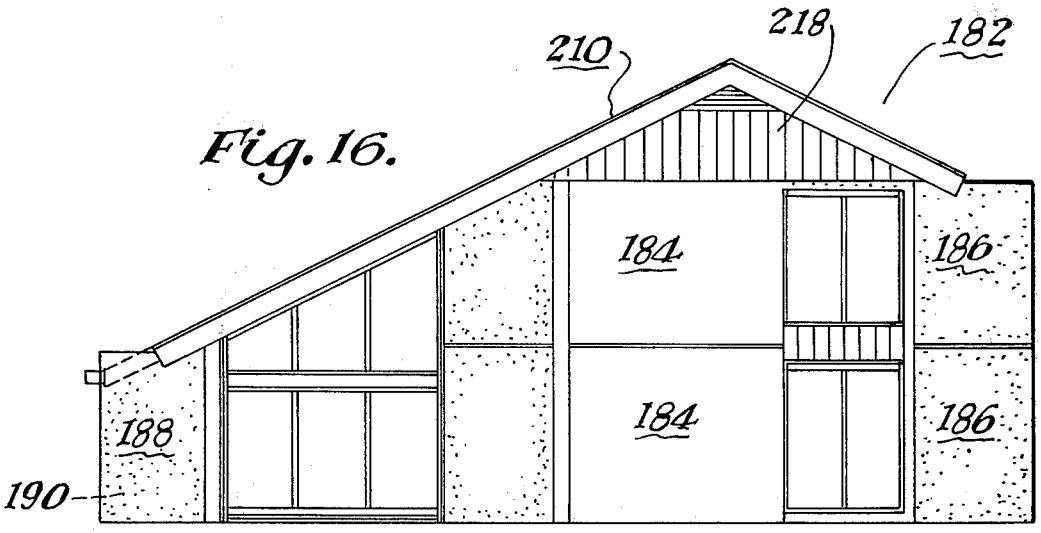
FIG. 16 is a side elevational view of the building construction shown in FIGS. 14 and 15.

As evident from FIGS. 14–16 the frontal structural units 188 are disposed in single storey relation to define the front of the building 182, including the entrance vestibule 190. On the other hand, pairs of the structural units 184, 186 are assembled jack-over-jack as evident from FIGS. 16 and 17 to delineate a second floor of the dwelling 182 (FIG. 15) and, together with the frontal structural units 188, the first floor of the building construction 182 (FIG. 14).

In contrast to the previously described structural units 41, 41′, the panels forming the structural units 184–188 are not joined at their central areas or center lines. In the case of the structural units 184, 186, the flying buttress effect of the previously described building constructions is reduced as exterior arms or extensions 192, 194 of the structural units 184, 186 are foreshortened. Similarly the interiorly projecting arms 196, 198 of the frontal structural units 188 are considerably foreshortened. The extensions 196, 198 are, however, useful in defining closets 200 or other built-ins (not shown).

As evident from FIGS. 14 and 15 the inward extensions 202,204 of the jack-over-jack structural units 184, 186 serve as room dividers or partitions between the various rooms on the first and second floors of the dwelling 182. As the several structural units 184, 186, 188 are essentially self-supporting the peripheral walls of the dwelling 182 can be completed by non-bearing or curtain walls 206,208, which in this example are essentially window or sliding glass door areas.

The roof structure 210 of the dwelling 182 is supported from the frontal structural units 188, from the inward extensions 202 of the structural units 184 and by the peripheral wall panels 214 of the structural units 186. As the panel 214 does not extend to the adjacent corners of the dwelling 182 a suitable beam can be mounted atop the upper structural unit 186 and extended along its panel 214. Alternatively, as shown (FIG. 17), reinforced bearing extensions 216 can be formed integrally with the peripheral wall panel 214 of the upper structural unit 186.

As better shown in FIG. 16, non-bearing gables 218 of wood or other suitable structural material can be constructed at each end of the ridge areas of the roof 210 and over the upper peripheral wall panels 220 of the second-storey structural units 184. The roof 210, together with the usual interior accessories of the dwelling 182, can otherwise be constructed in accord with known building techniques. As evident from FIGS. 14–16 living and dining areas 222 and 224 desirably are provided with slanted ceilings in conformance with the roof line of the dwelling 182.

Figure 18:
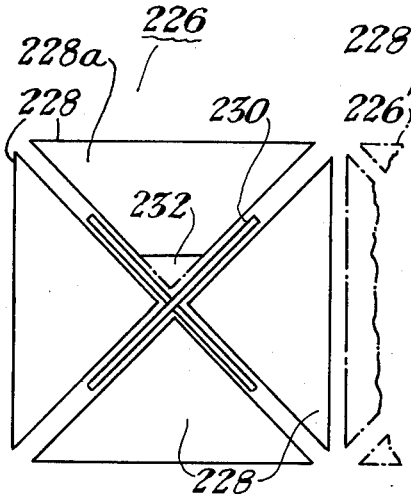
FIG. 18 is a top plan view of a building module arranged in accordance with the invention.
Figure 18A:
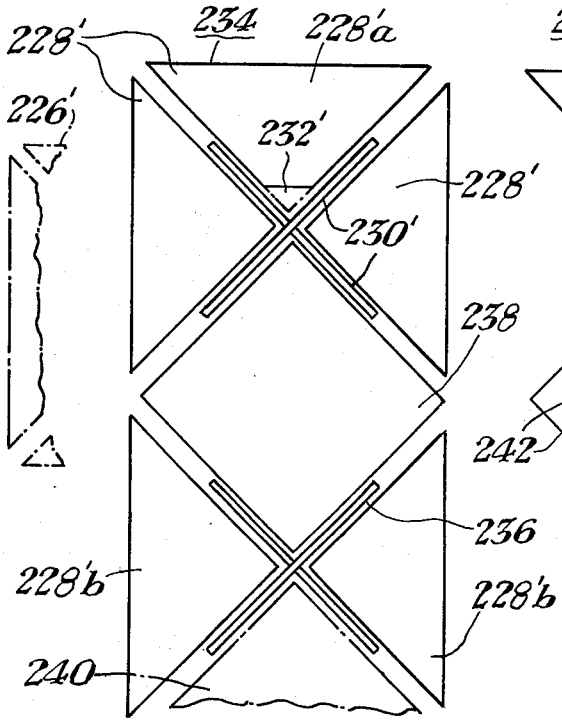
FIG. 18A is a similar view of another building module of the invention.
Figure 18B:
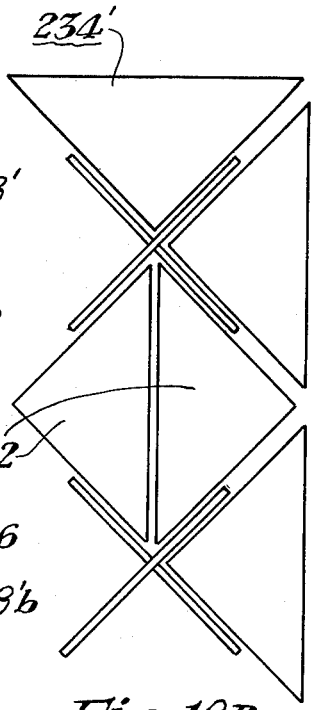
FIG. 18B is a similar view of still another building module of the invention.
Figure 18C:
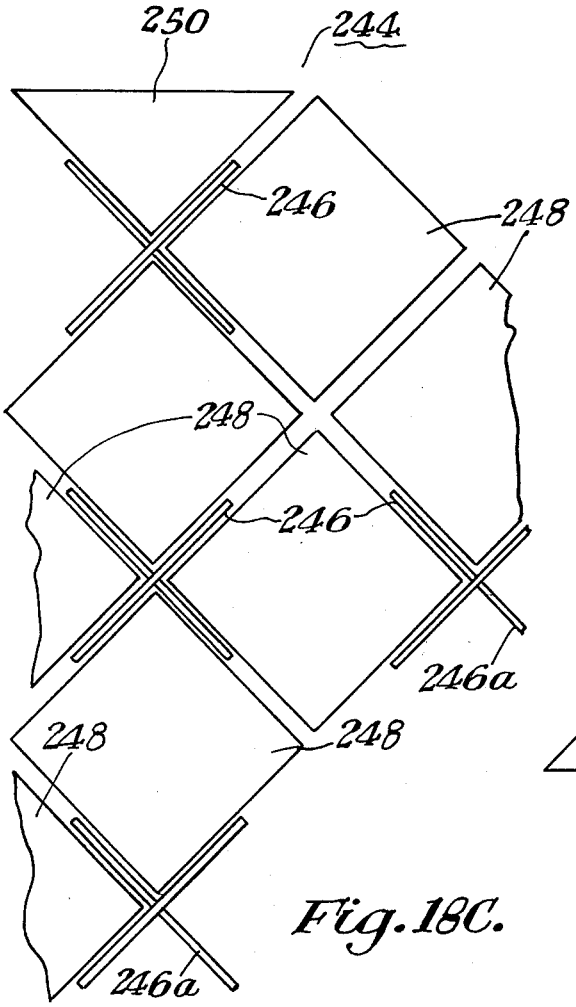
FIG. 18C is a similar view of a further building module of the invention.
Figure 18D:
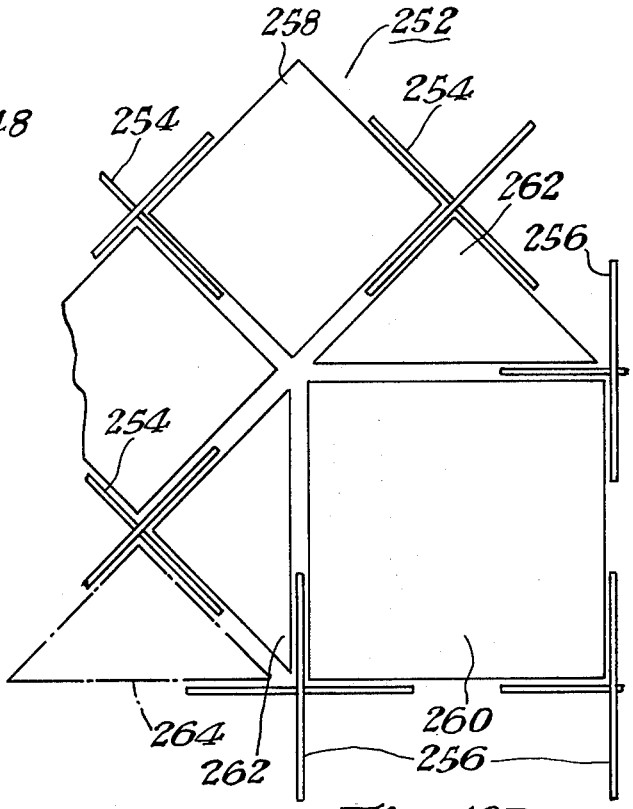
FIG. 18D is a similar view of another building module of the invention.

A number of modular building constructions, according to the invention, are illustrated in FIGS. 18–18D. In FIG. 18, building module 226 includes a number of triangular floor/ceiling panels 228 and a single structural unit 230. The unit 230 can be fabricated as discussed previously relative to FIGS. 1–8A, or alternatively the structural unit 230 can be molded integrally in the complete cruciform shape shown in FIG. 18. Likewise the structural units shown in other Figures of the drawings can be molded completely and integrally by known molding techniques. This can be accomplished by providing a mold structure (not shown) having cruciform shaped interior surfaces. The floor/-ceiling panels 228 can be supported from an adjacent pair of arms of the cruciform structural unit 230 and by external bearing wall means or by pillars (not shown). The four panels 228 can be supported from the structural unit 230 after the manner of FIG. 12 or 13 and related Figures. Alternatively each of the floor/ceiling panels 228 can be supported in cantilevered fashion from the structural unit 230 through the use of known construction techniques.

Desirably the apex of one of the floor/ceiling panels for example panel 228a is truncated at 232 to provide a vertical utility chase for the building module 226. This is particularly advantageous when the building construction 226 is a storey of a multi-storied building. A building construction utilizing the module 226 can be extended in any of a number of horizontal directions as denoted by adjacent building module 226'.

Another arrangement for such horizontal extension of the building construction is represented by building module 234 of FIG. 18A, where similar reference numerals with primed accents denote similar components of FIG. 18. The building module 234, as shown, includes cruciform structural units 230' and 236. The structural units 230', 236 support a generally rectangular or square floor/ceiling panel 238 therebetween. A uniform width of the building module 234 can be afforded by triangular floor/ceiling panels **228'*b* supported from the adjacent cruciform structural unit 236. The building module 234 can be terminated at this point with a terminal triangular panel or it can be extended further in the horizontal direction with a rectangular panel, as denoted by partial chain outline 240** thereof.

A similar building module 234' is illustrated in FIG. 18B and differs from that shown in FIG. 18A in that a pair of triangular panels 242 are substituted for the rectangular panel 238 of FIG. 18A. Desirably the triangular panels 242 are supported in edge-abutting or substantially edge-abutting relationship.

The building module 244 of FIG. 18C illustrates the possibilities of extension or repetition of the basic module in all horizontal directions. Thus, a number of cruciform structural units 246 support a number of floor/-ceiling panels 248 therebetween, of rectangular or square configuration. Those cruciform structural units **246*a* at the exterior of the building can provide a flying buttress effect as in certain of the preceeding Figures. Alternatively the use of appropriately located triangular floor/ceiling panels 250** at an external building surface or wall can be employed to conceal the flying buttress effect and to provide a more conventional outward appearance of the building.

The building module 252 of FIG. 18D illustrates the location of cruciform structural units 254,256 at differing distances from one another, where desired. The building module 252 also demonstrates the use of larger and smaller rectangular panels 258 and 260 respectively, along with suitably placed triangular floor/ceiling panels 262.

The cruciform structural units 254 and the associated floor/ceiling panels 258, 262 provide a convenient arrangement for disposing a wing of the building construction at a 45° angle to the balance of the building. As noted previously if the flying buttress effect of the structural units 254 or 256 is not desired, additional triangular floor/ceiling panels can be employed as denoted by chain outline 264.

From the foregoing it will be seen that a novel and efficient architectural constructional system has been described herein. The descriptive and illustrative materials employed herein are utilized for purposes of exemplyfing the invention and not in limitation thereof. Accordingly, numerous modifications of the invention will occur to those skilled in the art without departing from the spirit and scope of the invention. Moreover, it is to be understood that certain features of the invention can be used to advantage without a corresponding use of other features thereof.

I claim:

1. A preformed structural member comprising a generally rectangular precast slab having sufficient thickness for load-carrying capability, joining means extending across said slab and spaced from opposed sides thereof, about one-half of said joining means being a narrowly tapered solid region and the remainder of said joining means being a complementarily tapered void region, said solid joining region being capable of interfitting tightly within a void region of a similar structural member, said void joining region being capable of receiving a solid joining region of said other member in tightly interfitting relationship whereby said structural member when thus interfitted is positively prevented from angular displacement relative to said similar member, a second such slab, said second slab being inverted relative to said first-mentioned slab, and the tapered joining means of said second slab and of said first-mentioned slab being interfitted as aforesaid and extending generally vertically, the width of said second slab urging said joining means into a tapered interfitting relationship and maintaining said second slab and said first-mentioned slab rigidly in a predetermined attitude relative to one another to form a synergistic structural unit.

2. The combination according to claim 1 including said solid region being configured as a truncated pyramid, said void region being shaped complementarily thereto.

3. The combination according to claim 2 including a truncated top surface of said pyramid disposed to form a stop for the solid region of a similar slab upon engagement of the joining means thereof.

4. The combination according to claim 1 including increasingly chamfered edges of said slab joining means extending along said solid and said void regions respectively.

5. The combination according to claim 1 including a building structure constructed from at least one such structural unit, and arms of said structural unit forming at least partially bearing walls and partitions of said building structure.

6. The building structure according to claim 5 including at least one additional structural unit spaced horizontally from said one structural unit, and curtain walls and non-bearing partitions for completing the walls of said building structure.

7. The combination according to claim 5 including at least one prefabricated floor or ceiling panel mounted on said structural unit.

8. The combination according to claim 1 including a substantially coextending insulation integrally cast within said slab.

9. The combination according to claim 1 wherein said joining means are defined by a complementarily shaped lost mandrel.

10. The combination according to claim 9 wherein said lost mandrel includes two pairs of generally oppositely and axially extending legs, one pair of said legs being angularly displaced relative to the other pair of said legs.

11. The combination according to claim 10 wherein said pairs of legs are displaced ninety degrees with respect to one another.

12. The combination according to claim 10 wherein the outer surfaces of each of said legs are increasingly dished toward the central region of said lost mandrel.

13. The combination according to claim 5 including an arm of said structural unit extending exteriorly of said building structure for flying buttress effect.

14. The combination according to claim 5 including at least three additional structural units, said structural units being spacedly disposed in one or more groups of four.

15. The combination according to claim 14 including an arm of at least one of said structural units protruding exteriorly of said building structure for a flying buttress effect.

16. The combination according to claim 6 including each of said structural units including a pair of said slabs secured at right angles to one another, an adjacent pair of said structural units being displaced at least partially to enclose at least one room area therebetween, a curtain wall extending between juxtaposed ends of an arm of each of said adjacent units, and balcony walls extended in coplanar fashion from said juxtaposed unit arms to form a balcony or the like.

17. The combination according to claim 1 including the tapering of said void region being disposed at a different rotative position relative to the tapering of said solid region.

18. The combination according to claim 5 including at least one additional such unit, at least two such units being stacked one atop the other to form a multistoreyed building structure.

19. The combination according to claim 18 including a second pair of such units stacked one on top the other and juxtaposed to said two units, at least one prefabricated floor/ceiling panel, and means for supporting said panel adjacent horizontal junctions between said stacked units.

20. The combination according to claim 19 wherein said junctions define a keying groove, a cooperating keying groove is formed on juxtaposed peripheral edges of said panel, said grooves and clearances between said panel and said stacked units being keyingly filled with grouting material.

21. A building module comprising at least one upstanding cruciform synergistic structural unit, said unit including first and second structural slabs, each of said slabs having complementary narrowly tapered joining means extending thereacross, said second slab being inverted over said first slab to interfit their joining means and to form said cruciform unit, said joining means extending generally vertically when thus interfitted, the weight of said second slab urging said joining means into a tapered interfitting relationship and maintaining said slaps rigidly in a predetermined attitude relative to one another to form said synergistic unit, and a number of floor/ceiling panels supported from said unit.

22. A building module comprising a single upstanding cruciform structural unit together with four floor/ceiling panels supported from said unit, said panels being of triangular configuration and said unit being centrally disposed with respect to such panels.

23. A building module comprising at least two upstanding cruciform structural units, and an array of rectangular and triangular panels supported from said units.

24. The combination according to claim 21 wherein a plurality of said structural synergistic units are provided, said floor/ceiling panels being of rectangular configuration and extending between and supported respectively by adjacent pairs of said units.

25. A building module comprising a plurality of upstanding cruciform structural units, a number of rectangular floor/ceiling panels extending between and supported respectively by adjacent pairs of said structural units, some of said units being closer spaced and others of said units being farther spaced, said panels including smaller rectangular panels extending between said closer spaced units and larger rectangular panels extending between said farther spaced units, and at least one triangular shaped floor/ceiling panel extending between adjacent ones of said closer spaced units and said farther spaced units.

26. The combination according to claim 21 wherein an unsupported corner of at least one of said floor/ceiling panels is truncated in provision of a utility chase through said building module.

27. The combination according to claim 21 wherein at least one of said floor/ceiling panels includes a peripheral beam network formed integrally therewith.

* * * * *